United States Patent [19]

Linn

[11] Patent Number: 4,493,495

[45] Date of Patent: Jan. 15, 1985

[54] BINDING UNIT

[76] Inventor: Maynard W. Linn, 6336 N. Bergeron, Fresno, Calif. 93704

[21] Appl. No.: 362,021

[22] Filed: Mar. 25, 1982

[51] Int. Cl.[3] ..... A63F 3/04; A44B 21/00

[52] U.S. Cl. ..... 281/45; 24/494; 24/535

[58] Field of Search ..... 281/45; 24/243 R, 245, 24/255 R, 258, 67 R

[56] References Cited

U.S. PATENT DOCUMENTS

| | | | |
|---|---|---|---|
| 2,713,275 | 7/1955 | Gregston | 24/243 R |
| 2,885,758 | 5/1959 | Russo et al. | 24/255 R |
| 3,367,337 | 2/1968 | Javna et al. | 24/255 R |
| 3,379,237 | 4/1968 | Worthington | 24/255 R |
| 3,520,035 | 7/1970 | Clark | 24/255 R |
| 3,616,497 | 6/1970 | Esposito, Jr. | 24/255 R |
| 3,667,798 | 6/1972 | Rusztowicz | 24/255 R |
| 3,733,656 | 5/1973 | Stalder | 24/255 R |
| 3,845,521 | 11/1974 | McNichol | 24/255 R |
| 4,071,930 | 2/1978 | Tanaka | 24/255 R |
| 4,162,817 | 7/1979 | Briggs et al. | 24/255 R |

*Primary Examiner*—Paul A. Bell
*Assistant Examiner*—Paul M. Heyrana, Sr.
*Attorney, Agent, or Firm*—Don B. Finkelstein

[57] ABSTRACT

A device for binding the marginal edge of materials is provided which takes the form of a continuous section of resilient material. The section of the device includes a pair of legs on which the closing force can be released to allow the acceptance of the materials, a spline around which the legs pivot to close over the edge of the materials to hold them securely by the material engaging ends of the legs when the closing force is engaged and a latch to lock the legs closed. In certain embodiments one leg is fixed and the other leg pivots to accept the materials and to close over the edge of the materials.

22 Claims, 11 Drawing Figures

FIG. 4A
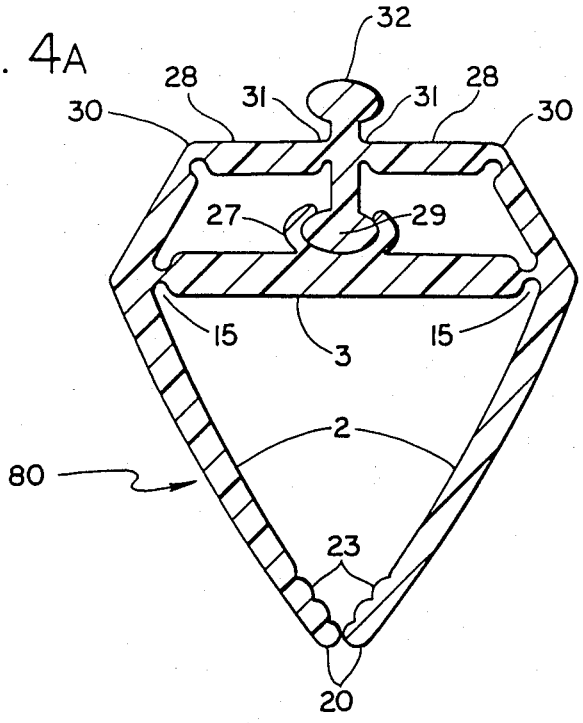
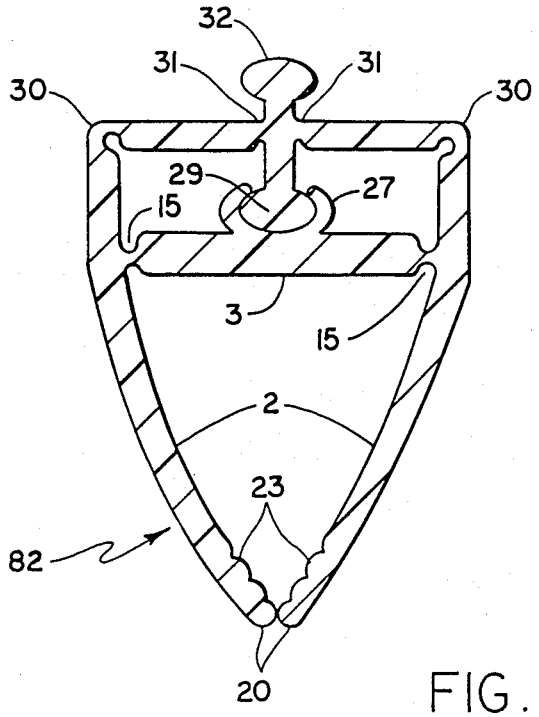
FIG. 4B

BINDING UNIT

BACKGROUND OF THE INVENTION

1. Field of the Invention

This invention relates generally to a binding and gripping unit for the edge of material and more particularly to improved binding unit that provides clamping pressure after a stack of material has been inserted into the binding unit which clamping pressure can be released to allow the removal of the stack of material without damage.

2. Description of the Prior Art

Some prior proposed devices for binding sheet materials have required that each sheet be perforated adjacent to one edge margin. If sheets are to be added, deleted or rearranged, the existing sheets must be removed from the device and then reinserted onto the device. Often the perforations in the sheets become torn with the result that a sheet may fall out of the assembled stack.

Other prior devices for binding sheet materials required that the stack of sheets be forced in between the clamping members to grip the inserted stack of papers and hold the sheets bound at the edge. Often this same resiliency causes the clamping members to damage the sheets as they are forced in between the clamping members. As the resiliency must be weak enough to allow the stack to be inserted, it is often weak enough to allow the stack to become dislodged during normal shuffling of the document.

Certain prior art structures have attempted to alleviate this condition. One such device as shown in U.S. Pat. No. 3,845,521 shows an adjustable binding unit that allows the gripping edges to be adjusted to accomodate a larger stack of materials. But the material must still be wedged between the gripping edges with the same magnitude of force that will hold the material resulting in damage to the material if the force is great or scattering of the material if the force is insufficient to hold the material during normal use.

U.S. Pat. Nos. 586,937, 2,282,565, and 2,869,210 show binding units that open to accept loose-leaf materials without perforations but are designed for heavy duty applications to display materials and none are proven to be completely satisfactory for the binding of small reports.

U.S. Pat. Nos. 3,665,563 and 3,698,043 show other binding units that are light weight and open to accept loose-leaf materials but are designed to be used in a plurality of units to prepare materials for display. Unless the units are tied together they will cause portions of the materials to be folded under with resulting damage to the loose-leaf materials.

SUMMARY OF THE INVENTION

Accordingly, it is the object of the present invention to provide a binding unit for loose-leaf sheets which opens to accept the stack of sheets and then closes around one edge of the stack.

It is another object of the present invention to provide the distinct advantages that the invention does not require perforations in the sheets to hold the sheets securely nor does the invention require that the sheets be forced between the retaining means. Thus, the sheets can be inserted, taken out, rearranged and inserted without damage from the retaining means.

The above and other objects of the present invention are achieved, according to a preferred embodiment thereof, by providing a binding unit that has two legs joined together near one end of the legs. The other end of the legs is free and can be pivotely opened to accept the edge of the materials. The free ends are then closed around an edge of a stack of material to clampingly secure the stacked material together. A latch is provided to hold the binding unit in the closed position. The binding unit can be unlatched and the free ends opened to allow the removal of the stack of material without damage.

BRIEF DESCRIPTION OF THE DRAWING

The above and other embodiments of the present invention may be more fully understood from the following detailed description, taken together with the accompanying drawing wherein similar reference characters refer to similar elements throughout and in which:

FIG. 4*a* is a sectional view of another embodiment of the present invention;

FIG. 4*b* is a sectional view of another embodiment of the present invention;

DESCRIPTION OF THE PREFERRED EMBODIMENTS

Figure 1:
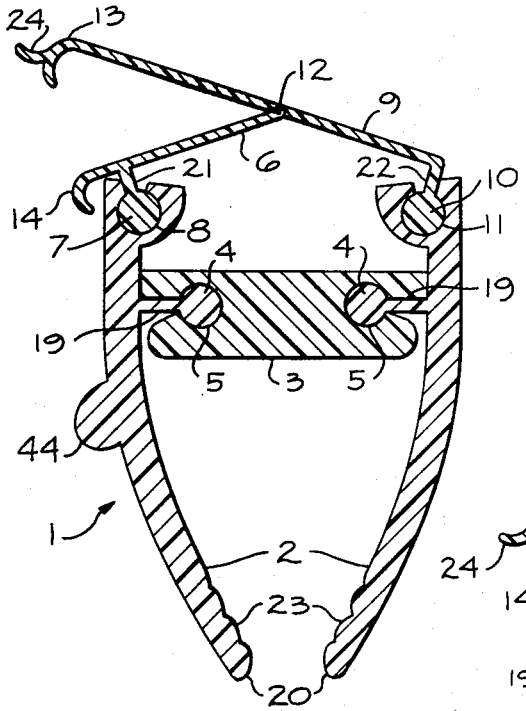
FIG. 1 is a sectional view of an embodiment of a binding unit according to the present invention in the open position thereof.

Referring now to FIG. 1 the binding unit 1 consists of two legs 2 each hinged to a spline 3 by a ball 4 and socket 5 joint. The ball 4 is made an integral part of the leg 2 being attached to the leg 2 by the stand off 19 and allows the leg 2 to pivot around the end of the spline 3. The spline 3 has a socket 5 formed to accept the ball 4 and allow movement of the ball 4 and stand off 19 such that the legs will open and close to their operational limits by this spline hinge without restriction from the spline 3. The free edges 20 of the legs 2 are formed with material engaging end portions 23.

Figure 2:
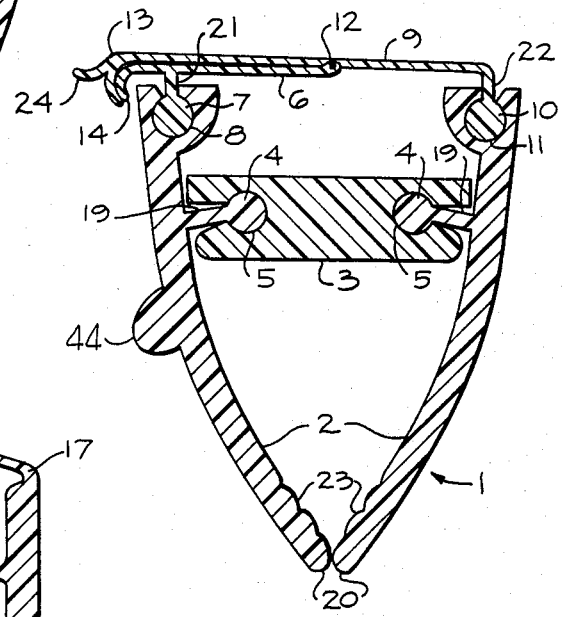
FIG. 2 is a sectional view of the embodiment of FIG. 1 in a closed position.

As can be seen from FIG. 1 and FIG. 2 the members 6 and 9 that provide the moving means to open and close the legs 2 are of preselected length and are attached at the remote ends of the legs 2. The shorter member 6 is hinged to the end of one leg 2 by a ball 7 and socket 8 joint. The ball 7 is made an integral part of the shorter member 6 being attached by the stand off 21 to allow the shorter member 6 to pivot around the end of the leg 2. A socket 8 is formed in the end of the leg 2 such that the shorter member 6 can be opened and closed. The longer member 9 is hinged to the end of the other leg 2 by means of a ball 10 and socket 11 joint with the ball 10 made an integral part of the longer member 9 being attached by the stand off 22. The socket 11 is formed in the end of the leg 2 such that the longer member 9 can be opened and closed. The shorter member 6 is attached to the longer member 9 by hinge 12 which is shaped to allow the longer member 9 to close over the shorter member 6. The hinge 12 is placed along the longer member 9 such that when the longer member 9 is closed over and become positioned adjacent to the shorter member 6 the legs 2 are pivoted around the spline 3 to the closed position shown in FIG. 2 with the material engaging end portions 23 forced together to hold loose-leaf sheet materials.

The end of the shorter member 6 is terminated in a catch 14. The end of the longer member 9 is terminated in a latch 13 which is placed so that when the longer member 9 is closed over the shorter member 6, the latch 13 engages the catch 14 to hold the members 6 and 9 closed.

The latch 13 is formed with a first manipulation on pad 24 to facilitate the opening and closing of the latch 13. A second manipulation pad 44 as shown in FIG. 1 may be formed as part of a leg 2 to provide a fingerhold to steady the binding unit while closing or opening the latch 13. The second manipulation pad 44 may be placed on the leg 2 and constructed to be of a height such that when the binding unit 1 holding a stack of material is set flat, the edges of the latch 13 and second manipulation pad 44 allow the binding unit 1 to lie in the same plane as the stack of material.

As the longer member 9 is opened, the ends of the legs 2 attached to members 6 and 9 are drawn closer together. This movement forces the legs 2 to pivot around the spline 3 so that the free edges 20 are opened to release any retained material and allow another stack of material to be placed between the legs 2 to be clampingly retained when the members 6 and 9 are closed.

Figure 3:
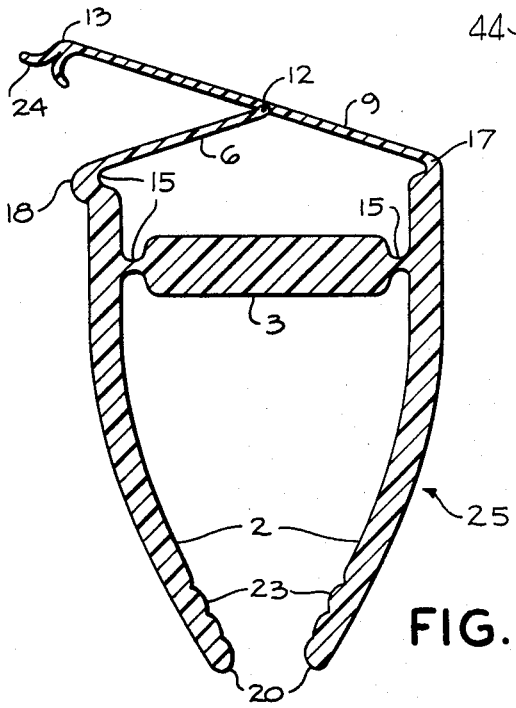
FIG. 3 is a sectional view of another embodiment of the present invention in the open position thereof.

FIG. 3 illustrates an embodiment, generally designated 25, which is generally similar to the binding unit 1. Each leg 2 is joined to one end of the spline 3 by a flexible web 15 serving as a hinge. The shorter member 6 is joined to one leg 2 by a flexible web 16. The longer member 9 is joined to the other leg 2 by a flexible web 17. A catch 18 is formed as an integral part of the leg 2 attached to the shorter member 6. The latch 13 engages the catch 18 when the longer member 9 is closed over the shorter member 6.

Figure 4:
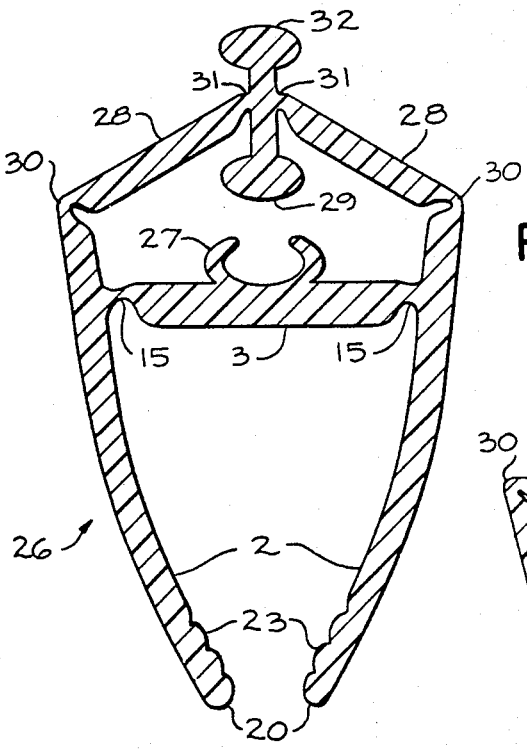
FIG. 4 is a sectional view of another embodiment of the present invention in the open position thereof.
Figure 5:
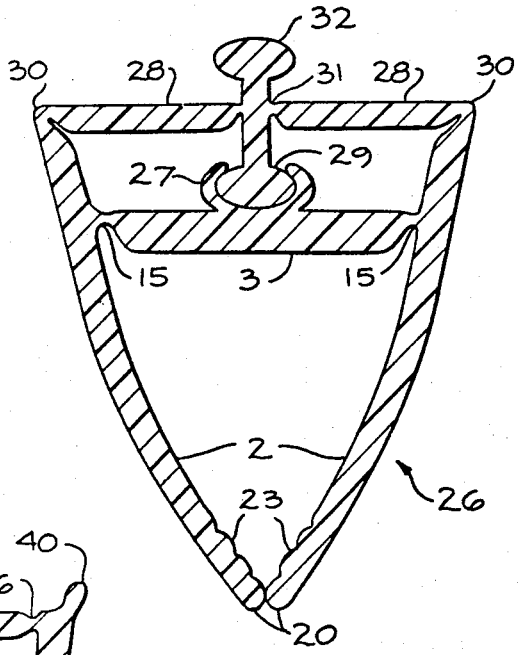
FIG. 5 is a sectional view of the embodiment of FIG. 1 showing it in the closed position thereof.

FIGS. 4 and 5 illustrate another embodiment, generally designated 26, which is generally similar to the binding unit 1. The legs 2 pivot around the spline 3. In FIG. 4, the legs 2 converge toward each other from the remote end to the free edges 20. In FIG. 4*a*, as shown in binding unit 80, the legs 2 converge toward each other from the spline 3 to the remote end and from the spline 3 to the free edges 20. In FIG. 4*b*, as shown in binding unit 82, the legs 2 are generally parallel from the remote end to the spline 3, thence converge toward each other to the free edges 20. Each leg 2 is attached to a forcing member 28 by a flexible web 30. The other end of each forcing member 28 is attached to a wedge 29 by a flexible web 31. A keeper 27 is formed as an integral part of the spline 3 and positioned to receive the wedge 29. When the wedge 29 is inserted into the keeper 27, the forcing members 28 spread the remote ends of the legs 2 causing the legs 2 to pivot around the spline 3 so that the free edges 20 close and the material engaging end portions 23 can clampingly engage a stack of loose-leaf materials. The top of the wedge 29 extends to form a fourth manipulation pad 32 so that the wedge 29 can be easily removed from the keeper 27 to open the free edges 20 of the legs 2.

Figure 6:
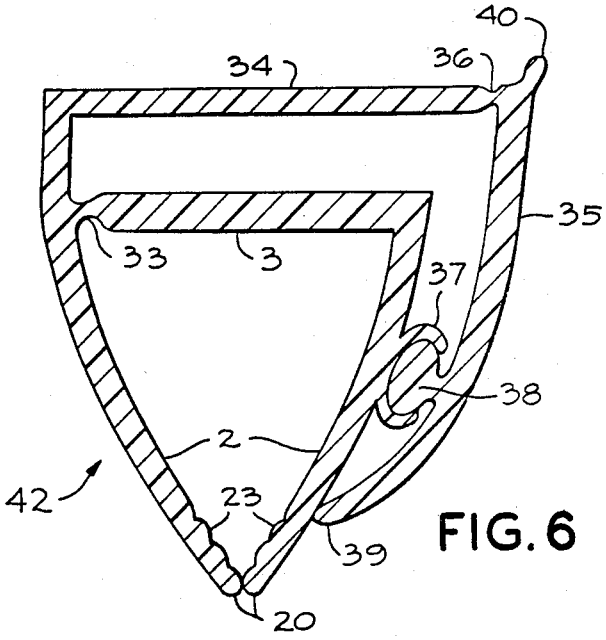
FIG. 6 is a sectional view of another embodiment of the present invention.
Figure 7:
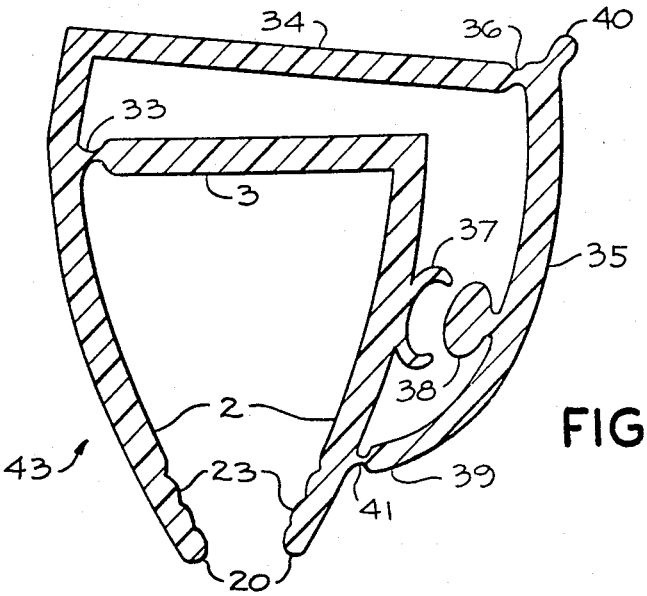
FIG. 7 is a sectional view of another embodiment of the present invention.

FIGS. 6 and 7 show still other embodiments, generally designated 42 and 43, of the binding unit 1.

FIG. 6 shows one leg 2 joined to the spline 3 by a flexible web 33 so that the leg 2 can pivot around the spline 3. The other leg is rigidly attached to the spline 3. A keeper 37 is made an integral part of the rigid leg 2.

A first clamping member 34 is rigidly attached to the remote end of the pivotal leg. The first clamping member 34 is attached to a second clamping member 35 by a flexible web 36. A wedge 38 is formed as an integral part of the second clamping member 35 and positioned so that as the wedge 38 is inserted into the keeper 37 one end 39 of the second clamping member 35 will act as a fulcrum, the shape of the second clamping member 35 being curved as shown in FIG. 6 so that the second clamping member 35 will pivot around the fulcrum and import a force through the first clamping member 34 to pivotal leg 2, thereby providing pivotal movement of the pivotal leg 2 around the spline 3 to the closed position causing the material engaging end portions 23 to be clampingly secured on the edge of a stack of loose-leaf materials.

A third manipulation pad 40 is formed as an integral part of the second clamping member 35 to facilitate the removal of the wedge 38 from the keeper 37 which opens the free edges 20 of the embodiment 42 to release any secured material and allow another stack of material to be placed between the legs 2 to be held by the embodiment 42.

FIG. 7 illustrates a modification of the embodiment 42 shown in FIG. 6. The operation of the modified embodiment 43 is similar to that of the embodiment 42 except that the clamping member 35 is joined to the non-pivotal leg 2 by a flexible web 41 to facilitate the alignment of the wedge 38 with the keeper 37 while closing the modified embodiment 43.

Certain of the embodiments are shown to have the free edges 20 apart when the opening and closing means is open. This state is not necessary and for certain uses such as binding a small number of loose-leaf sheets it may be preferred to have the free edges touching when the opening and closing means is open so that additional clamping force can be generated by the closing of the opening and closing means to more securely hold a thin stack of materials.

Figure 8:
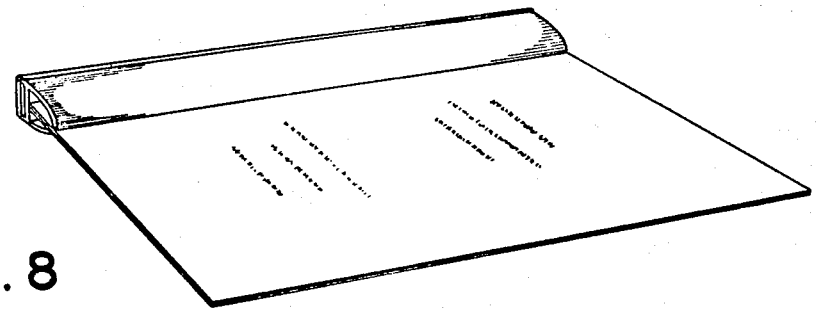
FIG. 8 is a perspective view illustrating a binding unit utilized to bind one edge of a stack of loose-leaf sheets.

Referring now to FIG. 8 shows in perspective a stack of loose-leaf sheets temporarily bound together at one edge by means of the binding unit. The strip depicted is not intended to represent any specific embodiment, but rather depicts a manner in which strips of the binding unit are utilized.

Figure 9:
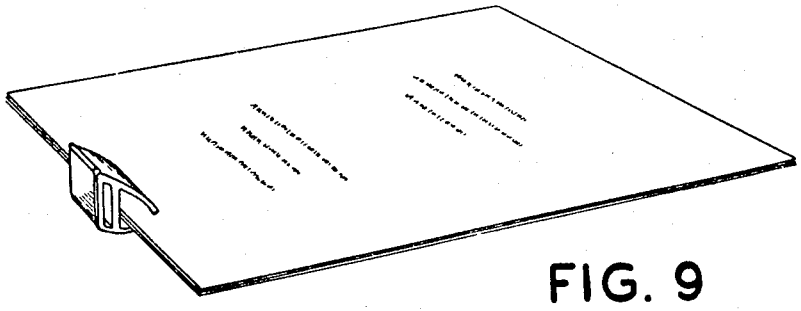
FIG. 9 is a perspective view showing a short section of a binding unit utilized to hold a stack of loose-leaf sheets.

Referring now to FIG. 9 shows in perspective a stack of loose-leaf sheets temporarily held together along a portion of an edge by a means of a length of the binding unit. The length depicted is not intended to represent any specific embodiment or size, but rather depicts a manner in which less than full edge lengths of the binding unit are utilized to temporarily clip loose-leaf materials.

It will be appreciated that the cooperative interaction between the latch 13 and catch 14, respectively, of FIGS. 1 and 2, the latch 13, and catch 18, respectively, of FIG. 3, the wedge 29 and keeper 27, respectively, of FIGS. 4, 4*a*, and 4*b*, and the wedge 38 and keeper 37, respectively, of FIGS. 6 and 7, all comprise latch means for selectively maintaining the moving means of each embodiment in a latched position. The latch 13, keeper 27, and keeper 37, comprise the female members of the catch means according to the principles of the present invention. The catch 14, catch 18, wedge 29, and wedge 38 comprise the male members of the catch means according to the principles of the present invention. The male members of the latch means according to the principles of the present invention, are releasably securable in the female members to provide the latch means in the latched position thereof.

Since certain changes may be made in the above apparatus without departing from the scope of the invention herein involved, it is intended that all matter contained in the above description as shown in the accompanying drawings shall be interpreted in an illustrative and not in a limiting sense.

What is claimed is:

1. A binding unit for loose-leaf sheet materials or the like of the type having an open position for insertion and a closed position wherein the loose-leaf materials are clamped therein comprising, in combination:

two legs, each of said legs having a free edge and a remote end spaced from said free edge, said free edges having cooperating material-engaging end portions;

a spline;

spline hinge means for coupling at least a first of said two legs to said spline in regions adjacent said remote end;

moving means coupled to at least said first of said two legs for moving said free edges between said closed position thereof and said open position thereof, said cooperating material-engaging end portions clampingly securing the loose-leaf sheet materials in said closed position, said moving means coupled to each of said two legs at said remote ends thereof to impart pivotal movement to said legs around said spline; and latch means having a portion thereof coupled to said moving means for selectively maintaining said moving means in a latched position thereof to provide said clampingly securing of the looseleaf materials by said cooperating material-engaging end portions, said latch means comprising a male member and a female member, and said male member of said latch means releasably securable in said female member in said latched position thereof.

2. A binding unit for loose-leaf sheet materials or the like of the type having an open position for insertion and a closed position wherein the loose-leaf materials are clamped therein comprising, in combination:

two legs, each of said legs having a free edge and a remote end spaced from said free edge, said free edges having cooperating material-engaging end portions;

a spline;

spline hinge means for coupling each of said legs to said spline in regions adjacent said remote end; and, moving means coupled to said two legs for moving said free edges between said closed position thereof and said open position thereof, said cooperating material-engaging end portions clampingly securing the loose-leaf sheet materials in said closed position, said moving means having:

first and second members, each member having a first end and a second end, said first member having a first preselected length and said second member having a second preselected length less than said first length;

a first hinge pivotally coupling said first end of said second member to one of said two legs;

a second hinge pivotally coupling said first end of said first member to the other of said two legs; and, a third hinge pivotally coupling said second end of said second member to said first member intermediate said first and said second end thereof, whereby for the condition of said first member positioned adjacent said second member, said first and second members force apart said remote ends of said two legs, thereby forcing together said free edges of said two legs, and for the condition of said first member pivotally spaced apart from said second member, said first and second members move said remote ends of said two legs toward each other thereby spreading apart said free edges.

3. A binding unit as described in claim 2 and further comprising:

maintaining means for maintaining said first member positioned adjacent said second member.

4. A binding unit as described in claim 3 wherein:

said maintaining means comprises:

a latch projecting from said second end of said first member; and a catch projecting from said first end of said second member and, said latch disposed to engage said catch for the condition of said first member positioned adjacent said second member.

5. A binding unit as described in claim 3 wherein:

said maintaining means comprises:

a catch projecting from said remote end of said leg attached to said second member; and, a latch projecting from said second end of said first member, and said latch disposed to engage said catch for the condition of said first member positioned adjacent said second member.

6. A binding unit as described in claim 1 or 2, wherein:

said spline hinge means comprises a ball and socket joint.

7. A binding unit as described in claim 1 or 2, wherein:

said spline hinge means comprises a flexible web.

8. A binding unit as described in claim 1 or 2, wherein:

each of said two legs converge toward each other from said spline hinge means to said remote end and to said free edge for the closed condition of said free edges.

9. A binding unit as described in claims 1 or 2, wherein:

said two legs are substantially parallel in regions from said remote ends to said spline hinge means, and said two legs converge toward each other in regions between said spline hinge means and said free edges for the closed condition of said free edges.

10. A binding unit for loose-leaf sheet materials or the like of the type having an open position for insertion and a closed position wherein the loose-leaf materials are clamped therein, comprising, in combination;

a unitary elongated section of resilient material having:

two legs, each of said legs having a free edge and a remote end spaced from said first edge, said free edges having cooperating material-engaging end portions;

connecting means joining each of said legs in regions adjacent said remote end said connecting means comprising:

a spline having two ends interconnecting said two legs and disposed therebetween; and, spline hinge means for coupling each of said legs to one end of said spline in regions adjacent said remote end to provide pivotal movement to each leg;

a keeper mounted on said spline;

a wedge removably retainable in said keeper;

a manipulation pad mounted on said wedge engagable by a user's fingers for moving said wedge into and out of retention by said keeper;

two forcing members joined by a flexible web to opposite sides of said wedge at one end of each forcing member; and, forcing member hinge means for coupling the other end of each forcing member to said remote end of each leg, whereby as said wedge is inserted into said keeper, said forcing members move said two legs pivotly around said spline to said closed position whereby the cooperating material-engaging end portions clampingly secure the loose-leaf sheet materials.

11. A binding unit for loose-leaf materials or the like of the type having an open position for insertion and closed position wherein the loose-leaf materials are clamped therein, comprising, in combination:

a unitary elongated section of resilient material having:

two legs, each of said legs having a free edge and a remote end spaced from said free edge, said free edges having cooperating material-engaging end portions;

connecting means joining the first leg in regions adjacent said remote end and at said remote end of the second leg, said connecting means including:

a spline having first and second ends interconnecting said two legs and disposed therebetween, the second end of said spline being fixedly coupled to said remote end of said second leg; and, spline hinge means for coupling said first leg to said first end of said spline to provide pivotal movement to said first leg;

a keeper mounted on said second leg;

a wedge removably retainable in said keeper; and, closing means coupled to said remote end of said first leg, said closing means comprising:

first and second clamping members each having first and second ends; and a flexible web joining said first end of said first clamping member to said first end of said second clamping member;

wherein:

said second end of said first clamping member being fixedly attached to the remote end of said first leg and generally aligned in a plane parallel to said spline;

said second clamping member having said wedge mounted thereon intermediate said first and second ends of said second clamping member; and, said second clamping member being shaped so that as said wedge is engaged into said keeper, said second end of said second clamping member provides a fulcrum for said closing means for the condition of said wedge positioned to be retained in said keeper thereby pivotally moving said first leg to the closed position whereby the cooperating material-engaging end portions clampingly secure the loose-leaf sheet materials.

12. The binding unit as defined in claim 11 wherein:

said second end of said second clamping member is joined to said second leg by a flexible web.

13. A binding unit as described in claim 2, 3, 10, 11, or 12, wherein:

each of said two legs converge toward each other from said remote end to said free edges for the closed condition of the free edges.

14. A binding unit as described in claim 10 wherein:

each of said legs converges toward each other from said connecting means to said remote end and from said connecting means to said free edge for the closed condition of said free edges.

15. A binding unit as described in claim 10 wherein:

said two legs are substantially parallel in regions from said remote end to said connecting means; and, said two legs converge toward each other in regions from said connecting means to said free edge for the closed condition of said free edges.

16. A binding unit described in claim 11 or 12 wherein:

said first leg converges inwardly from said connecting means to said remote end; and, said first and said second legs converge toward each other in regions from said connecting means to said free edges for the closed condition of said free edges.

17. A binding unit as described in claim 11 or 12 wherein:

said first leg in the region between said remote end and said connecting means is generally perpendicular to said spine; and, said first and said second legs converge toward each other in regions from said connecting means to said free edges for the closed condition of said free edges.

18. A binding unit as described in claim 4 or 5 wherein:

said first member further comprises a manipulation pad engagable by a user's fingers to engage and disengage said latch from said catch.

19. A binding unit as described in claim 4 or 5 and further comprising:

a manipulation pad mounted on said leg attached to said second member engageable by a user's fingers to steady said binding unit while the user is engaging and disengaging said latch from said catch.

20. A binding unit as described in claim 12 wherein:

said second clamping member further comprises a manipulation pad at said first end thereof engagable by a user's fingers while the user is moving said second clamping member with said wedge to be retained by or disengaged from said keeper.

21. A binding unit as described in claim 2 wherein:

each of said first and second hinges comprise a ball and socket joint.

22. A binding unit as described in claim 2 wherein:

each of said first and second hinges comprise a flexible web.

* * * * *